US006516690B2

(12) United States Patent
Chen

(10) Patent No.: US 6,516,690 B2
(45) **Date of Patent: *Feb. 11, 2003**

(54) PAWL SHIFTING DEVICE FOR RATCHET TOOLS

(76) Inventor: Yu Tang Chen, No. 1, Alley 16, Lane 40, Tinn Te Rd., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/884,277

(22) Filed: Jun. 20, 2001

(65) Prior Publication Data

US 2002/0194965 A1 Dec. 26, 2002

(51) Int. Cl.[7] ..... B25B 13/46
(52) U.S. Cl. ..... 81/63; 192/46
(58) Field of Search ..... 81/60–63.2; 192/46

(56) References Cited

U.S. PATENT DOCUMENTS 3,265,171 A * 8/1966 Kilness ..... 81/63
5,957,009 A * 9/1999 McCann ..... 81/63.2
6,164,167 A * 12/2000 Chen ..... 81/63
6,260,448 B1 * 7/2001 Chaconas ..... 81/63
6,282,991 B1 * 9/2001 Hu ..... 81/63

* cited by examiner

*Primary Examiner*—James G. Smith

(57) ABSTRACT

A ratchet tool includes an engaging member rotatably received in the head of the tool and a pawl is engaged with the toothed outer periphery of the engaging member. A notch is defined in a side opposite to the toothed surface of the pawl and one of two ends of the pawl is removably engaged with the inner periphery of the head. A selection member is received in the head and has a receiving hole for receiving a pin and a second spring therein. The pin is biased by the second spring and engaged with the notch. A protrusion extends from the selection member and a ball received in a recess in the inner periphery of the head is engaged with the protrusion.

3 Claims, 7 Drawing Sheets

PAWL SHIFTING DEVICE FOR RATCHET TOOLS

FIELD OF THE INVENTION

The present invention relates to a pawl shifting device for a ratchet tool and includes a selection member having a pin biased by a spring and the pin is engaged with a notch in the pawl. The selection member is biased by a ball in the head of the tool.

BACKGROUND OF THE INVENTION

A conventional ratchet tool generally includes a ring-shaped head in which an engaging member is rotatably received and a pawl member is engaged with a toothed outer periphery of the engaging member. The pawl member is urged by a ball which is biased by a spring which is received in a recess defined in an inner periphery of the ring-shaped head of the tool. When using the tool, the user switch a selection lever which is connected to the pawl to let the pawl be engaged with the engaging member at one position which is maintained by the ball urging the pawl. However, it is hard to switch the selection lever to shift the pawl especially the selection lever is small and thin and it requires a large force to switch the selection lever.

SUMMARY OF THE INVENTION

In accordance with one aspect of the present invention, there is provided a ratchet tool and comprises a ring-shaped head and a handle extends from the head. A recess is defined in an inner periphery of the head for receiving a ball and a first spring therein. An engaging member is rotatably received in the head and has a toothed outer periphery with which a first toothed side of a pawl is engaged. A notch is defined in a second side of the pawl and one of two ends of the second side of the pawl is removably engaged with the inner periphery of the head. A selection member is received in the head and has a receiving hole defined in a first side thereof. A pin and a second spring are received in the receiving hole. The pin is biased by the second spring and engaged with the notch. A selection lever is connected to the selection member and a protrusion extends from the second side of the selection member. The ball is engaged with the protrusion.

The primary object of the present invention is to provide a ratchet tool that has a selection member to easily switch the pawl.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
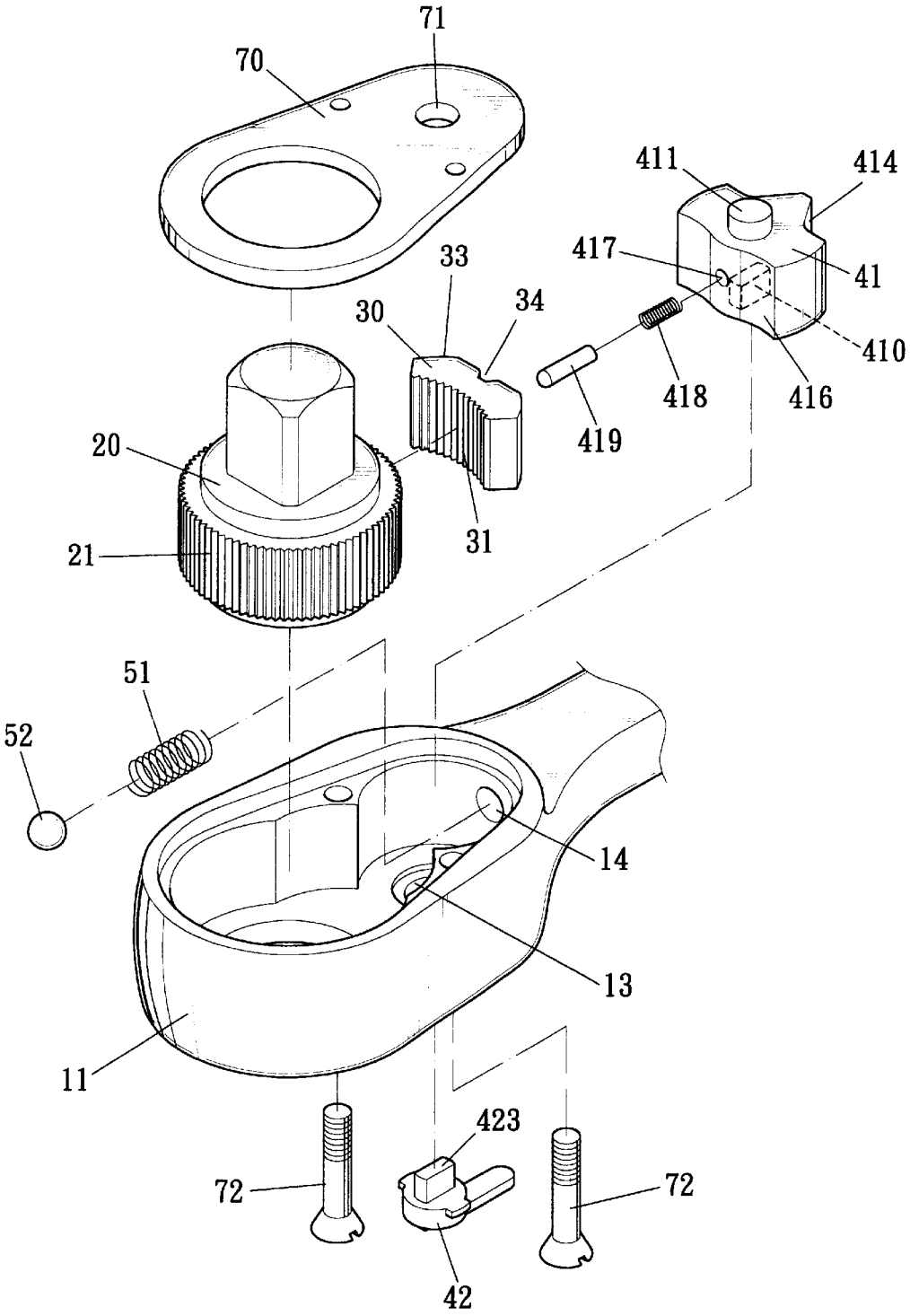
FIG. 1 is an exploded view to show a ratchet tool of the present invention.
Figure 2:
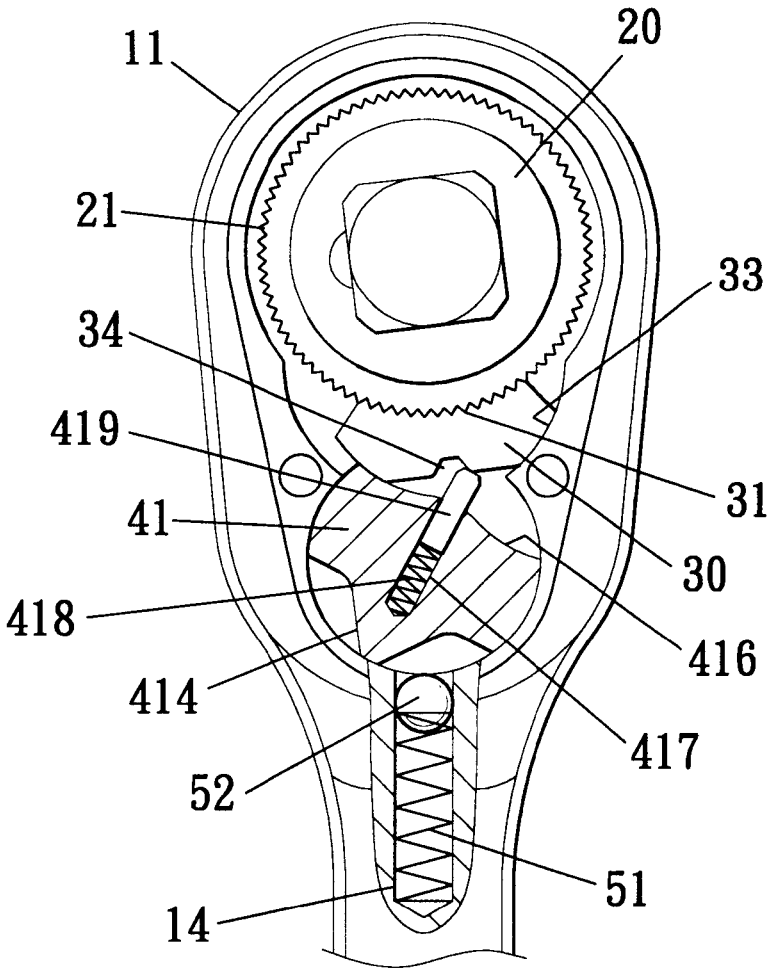
FIG. 2 is a plan view to show the ratchet tool of the present invention.

Referring to FIGS. 1 and 2, the ratchet tool of the present invention comprises a ring-shaped head 11 and a handle extends from the head 11. A recess 14 is defined in an inner periphery of the head 11 and a ball 52 and a first spring 51 are received in the recess 14. An engaging member 20 is rotatably received in the head 11 and has a toothed outer periphery 21 and an engaging rod which extends through a hole in a top plate 70 which seals a top of the head 11 of the tool by two bolts 72. A pawl 30 has a toothed surface 31 defined in a first side thereof and the toothed surface 31 is engaged with the toothed outer periphery 21 of the engaging member 20. A notch 34 is defined in a second side of the pawl 30 and one of two ends 33 of the second side of the pawl 30 removably is engaged with the inner periphery of the head 11.

A selection member 41 is received in the head 11 and has a receiving hole 417 defined in a first side thereof. A pin 419 and a second spring 418 are received in the receiving hole 417, wherein the pin 419 is biased by the second spring 418 and is engaged with the notch 34. The first side of the selection member 41 has curved surfaces 416 so that one of the two ends 33 of the second side of the pawl 30 is smoothly engaged therewith. The selection member 41 has an engaging recess 410 defined in an underside thereof and a selection lever 42 has a rectangular block 423 which is received in the engaging recess 410 in the selection member 41 via a hole 13 defined in a bottom plate of the head 11. A circular rod 411 extends from top of the selection member 41 and is rotatably engaged with a hole 71 in the top plate 70 so that the selection member 41 is rotatable about the circular rod 411. A protrusion 414 extends from the second side of the selection member 41 and the ball 52 is engaged with the protrusion 414.

Figure 3:
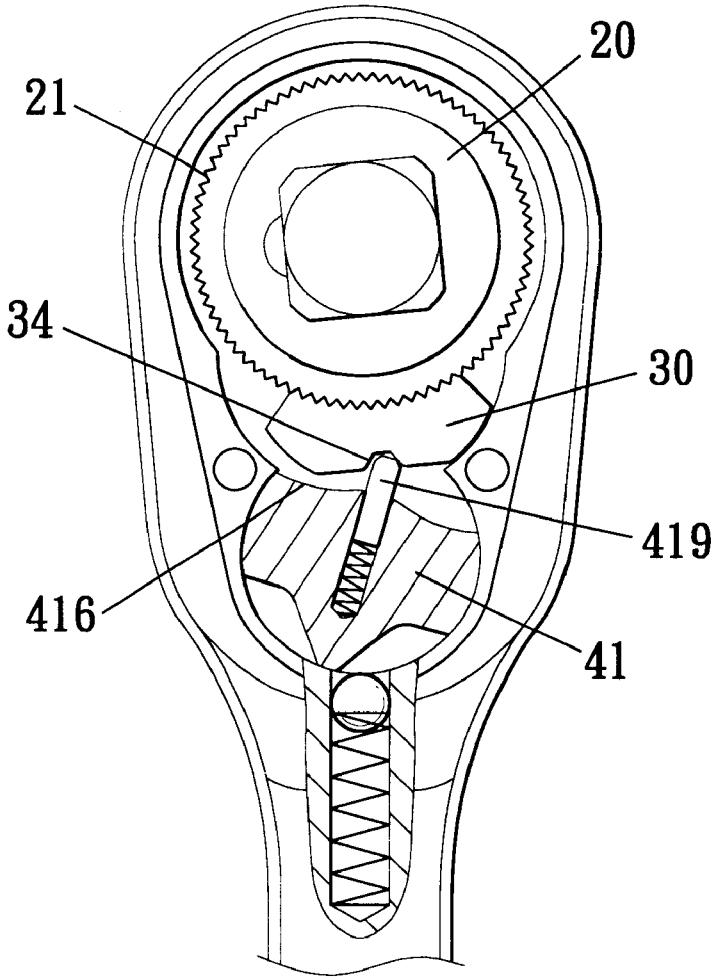
FIG. 3 is a plan view to show the pawl is pushed toward the pin by the engaging member when rotating the ratchet tool of the present invention.
Figure 4:
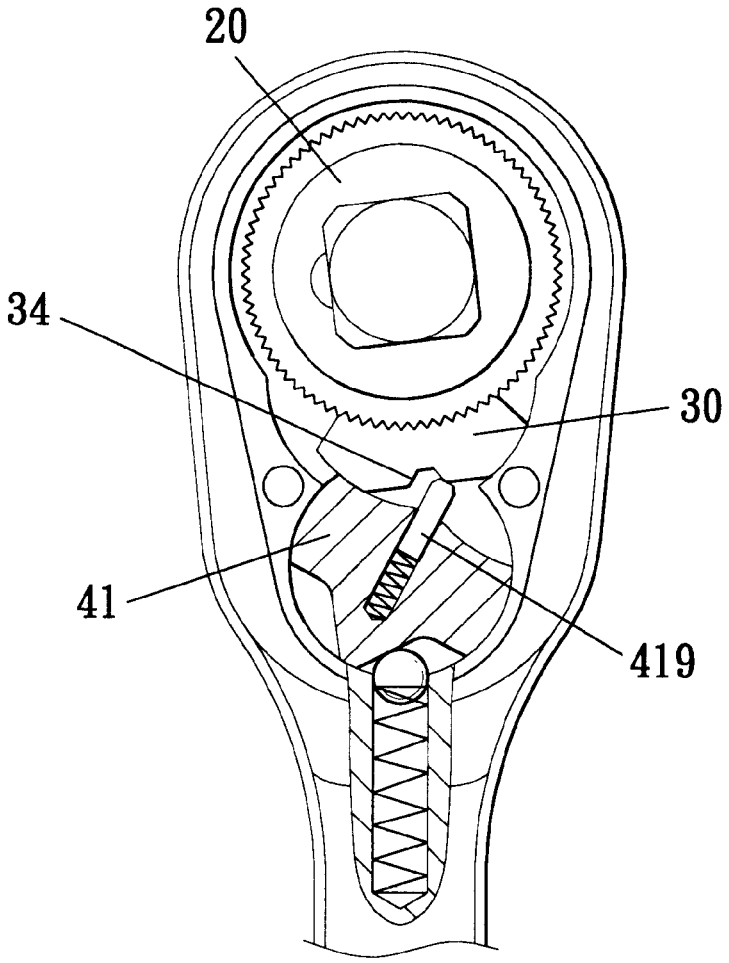
FIGS. 4 to 7 show the change of the pawl by switch the selection member to that the pawl member is co-rotated with the engaging member to output a torque.
Figure 5:
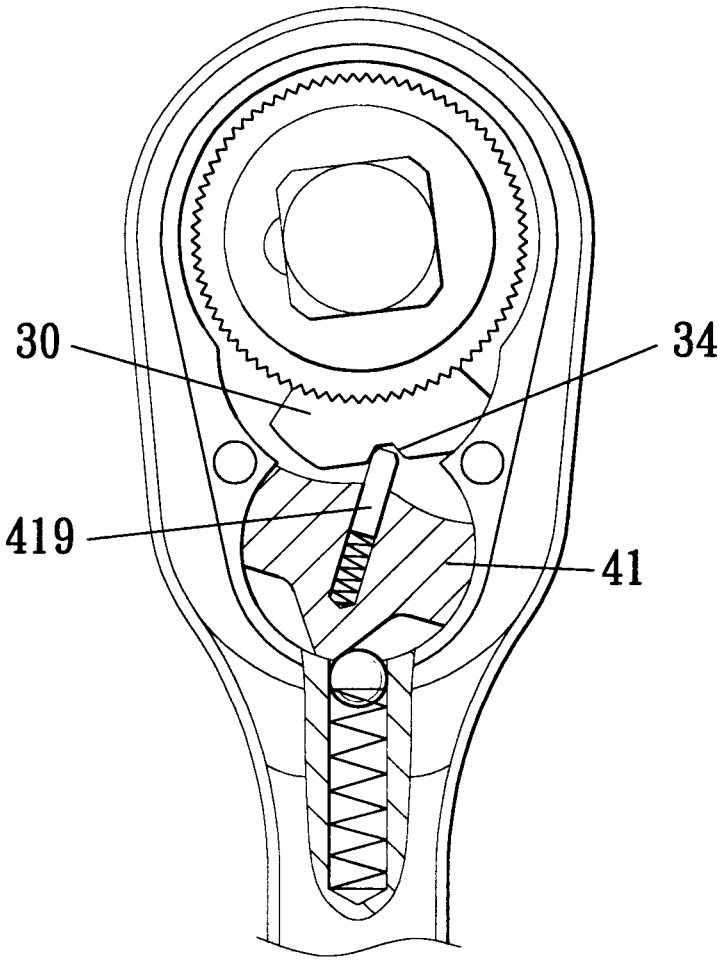
Figure 6:
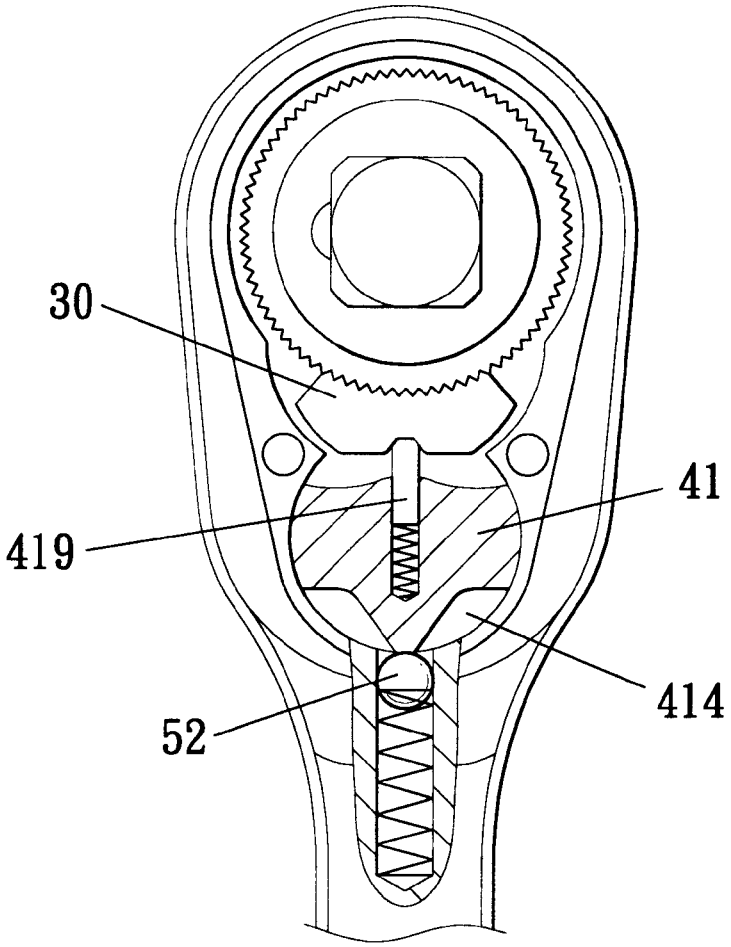

As shown in FIG. 3, when the tool is rotated counter clockwise, the pawl 30 is pushed by the engaging member 20 so that the pawl 30 pushes the pin 419 to compress the second spring 418, so that the pawl 30 moves over the toothed outer periphery 21 of the engaging member 20 to produce click sound and the engaging member 20 holding an object (not shown) is not rotated.

Figure 7:
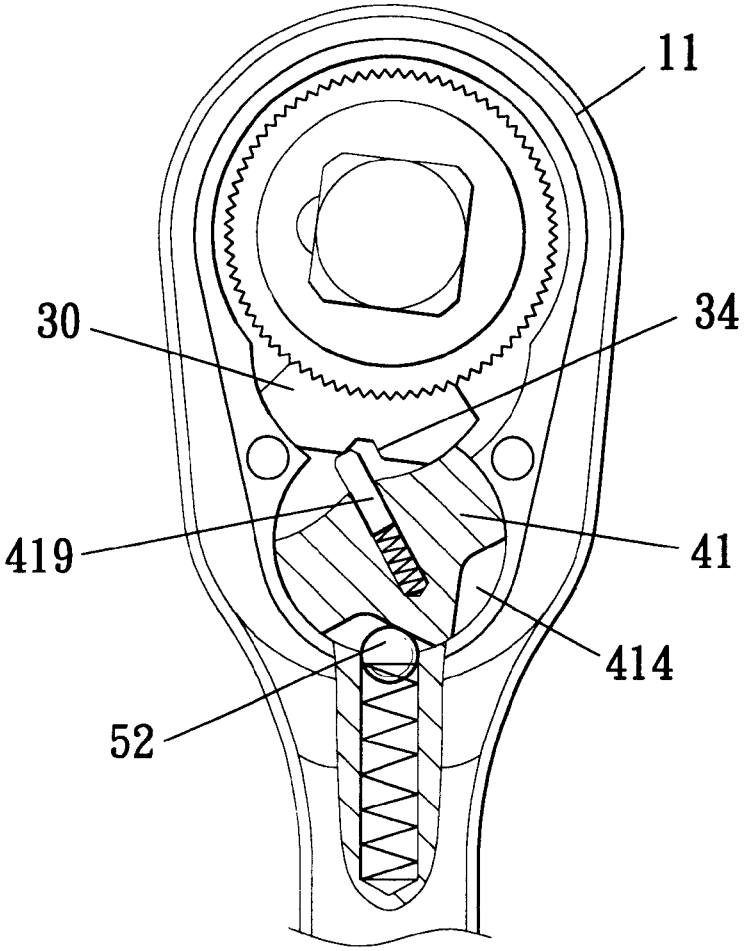

As shown in FIGS. 4 to 7, when rotating the selection lever 42 from right to left, the pin 419 engaged with the notch 34 pushes the pawl 30, and the protrusion 414 moves over the ball 52 to the position as shown in FIG. 7. The pawl 30 is then shifted to the left and the left end 33 contacts the inner periphery of the head 11. When rotating the tool counter clockwise, the engaging member 20 and the tool are rotated together to output a torque.

While we have shown and described the embodiment in accordance with the present invention, it should be clear to those skilled in the art that further embodiments may be made without departing from the scope of the present invention.

What is claimed is:

1. A ratchet tool comprising:

a ring-shaped head and a handle extending from said head, a recess defined in an inner periphery of said head and a ball and a first spring received in said recess;

an engaging member rotatably received in said head and having a toothed outer periphery, a pawl having a toothed surface defined in a first side thereof and said toothed surface engaged with said toothed outer periphery of said engaging member, a notch defined in a second side of said pawl and one of two ends of said second side of said pawl removably engaged with said inner periphery of said head, and a selection member received in said head and having a receiving hole defined in a first side thereof, two curved surfaces defined in said first side of said selection member, a pin and a second spring received in said receiving hole, said pin biased by said second spring and engaged with said notch, one of said two ends of said second side of the pawl being smoothly engaged with one of said two curved surfaces of said selection member, a selection lever connected to said selection member and a protrusion extending from a second side of said selection member, said ball engaging with said protrusion.

2. The ratchet tool as claimed in claim 1, wherein said selection member has an engaging recess defined in an underside thereof and said selection lever has a rectangular block which is received in said engaging recess in said selection member.

3. A ratchet tool comprising:

a ring-shaped head and a handle extending from said head, a recess defined in an inner periphery of said head and a ball and a first spring received in said recess;

an engaging member rotatably received in said head and having a toothed outer periphery, a pawl having a toothed surface defined in a first side thereof and said toothed surface engaged with said toothed outer periphery of said engaging member, a notch defined in a second side of said pawl and one of two ends of said second side of said pawl removably engaged with said inner periphery of said head, and a selection member received in said head and having a receiving hole defined in a first side thereof, two curved surfaces defined in said first side of said selection member, a pin and a second spring received in said receiving hole, said pin biased by said second spring and engaged with said notch, one of said two ends of said second side of the pawl being smoothly engaged with one of said two curved surfaces of said selection member, said selection member having an engaging recess defined in an underside thereof, a selection lever having a rectangular block which is received in said engaging recess in said selection member, a protrusion extending from a second side of said selection member, said ball engaging with said protrusion.

* * * * *